US006105479A

United States Patent [19]

Neier et al.

[11] Patent Number: 6,105,479

[45] Date of Patent: Aug. 22, 2000

[54] VARIABLE DIAMETER CUTTER ROLLER OR GLUE SPREADING ROLLER

[75] Inventors: Heinz Neier, Ladbergen; Karl-Heinz Feld, Lengerich; Gustav Kuckhermann, Bielefeld, all of Germany

[73] Assignee: Windmöller & Hölscher, Lengerich, Germany

[21] Appl. No.: 08/875,963

[22] PCT Filed: Jan. 30, 1996

[86] PCT No.: PCT/EP96/00372

§ 371 Date: Aug. 7, 1997

§ 102(e) Date: Aug. 7, 1997

[87] PCT Pub. No.: WO96/24471

PCT Pub. Date: Aug. 15, 1996

[30] Foreign Application Priority Data

Feb. 8, 1995 [DE] Germany ..... 195 04 162

[51] Int. Cl.[7] ..... B26D 1/56

[52] U.S. Cl. ..... 83/304; 83/331; 83/674; 83/677; 156/536

[58] Field of Search ..... 83/304, 305, 331, 83/674, 677, 698.51; 156/536

[56] References Cited

U.S. PATENT DOCUMENTS

| | | | |
|---|---|---|---|
| 2,013,086 | 9/1935 | Baker . | |
| 3,296,909 | 1/1967 | Hudak et al. | 83/305 |
| 3,583,294 | 6/1971 | Lense et al. | 83/331 |
| 3,635,440 | 1/1972 | Van Gompel . | |
| 3,825,196 | 7/1974 | Yamazaki . | |
| 4,159,662 | 7/1979 | Weaver | 83/304 |
| 4,240,313 | 12/1980 | Gillespie | 83/677 |
| 4,500,042 | 2/1985 | Goertz et al. | 83/677 |
| 4,640,164 | 2/1987 | Pavlov | 83/304 |
| 4,872,382 | 10/1989 | Benner, Jr. et al. . | |
| 5,557,997 | 9/1996 | Wunderlich et al. | 83/698.51 |

FOREIGN PATENT DOCUMENTS

| | | |
|---|---|---|
| 0364864 | 4/1990 | European Pat. Off. . |
| 0559077 | 9/1993 | European Pat. Off. . |
| 0664208 | 7/1995 | European Pat. Off. . |
| WO93/19904 | 10/1993 | WIPO . |

*Primary Examiner*—M. Rachuba
*Attorney, Agent, or Firm*—Dilworth & Barrese

[57] ABSTRACT

A variable-diameter knife roll is provided with a knife extending parallel to the axis of the roll placed generally radially on a diametral plane, such knife being mounted on a knife carrier able to be adjusted radially outwardly and inwardly. In order to be able to rapidly and simply set the knife roll to suit different formats the knife carrier is articulatingly connected with the joints connecting the two links of two expanding grilles or with respectively one of the arms extending past such joints, of one of the links of the two expanding grilles. Respectively one inner joint of a link of one of the two expanding grilles is arranged fixedly on a knife roller shaft and the respectively other inner joint of the other link is arranged for adjustment in the axial direction on or in the knife roll shaft.

11 Claims, 6 Drawing Sheets

VARIABLE DIAMETER CUTTER ROLLER OR GLUE SPREADING ROLLER

The invention relates to a variable-diameter knife roll comprising a knife extending parallel to the axis of the roll placed generally radially on a diametral plane, such knife being mounted on a knife carrier able to be adjusted radially outwardly and inwardly.

BACKGROUND OF THE INVENTION

Knife rolls for making transverse separating cuts or cuts in the form of rows of perforations have become known in various different designs. The term "knives" is employed herein to denote both those producing smooth cuts and also lines of perforations. In accordance with the different formats of the blanks, preferably in the form of bag blanks, webs of paper or plastic must be provided with transverse cuts and more especially with transverse perforation cuts or lines at different distances apart. There is consequently a need for a way of setting knife rolls to different formats rapidly and simply.

SUMMARY OF THE INVENTION

One object of the invention is hence to create a knife roll of the type initially mentioned which may be rapidly and simply reset to different formats, that is to say to different distances apart of the cuts made in a continuously supplied web.

In accordance with the invention this aim is to be attained with a knife roll of the type initially mentioned wherein the knife carrier is articulatingly connected with the joints connecting the two links of two expanding grilles or with respectively one of the arms extending past such joints, of one of the links of the two expanding grilles, and wherein respectively one inner joint of a link of one of the two expanding grilles is arranged fixedly on a knife roller shaft and the respectively other inner joint of the other links is arranged for adjustment in the axial direction on or in the knife roll shaft. The radial distance of the knife carrier and accordingly the format of the blank to be cut from the web or separated therefrom by lines of transverse perforations may be set in a simple way using the knife roll of the invention just by adjustment of the inner joints of the one set of links of the expanding grilles in the axial direction.

It is convenient for the knife roll shaft to be a hollow shaft, wherein a slide is guided for axial sliding movement and on which the adjustable inner joints of the other set of links are arranged, the slide arrangement being provided with a setting drive.

The setting drive may comprise a lead screw nut connected with the slide arrangement and a lead screw able to be screwed into same.

In order to perform radial adjustment of the knife carriers, the lead screw may be held so that while being unable to be moved in relation to the hollow shaft in the axial direction, it can be turned in relation to same after slackening of a holding or arresting device.

In accordance with a preferred development of the invention the lead screw is mounted on a radially extending carrier of the hollow shaft for free rotation in the same, furthermore on a terminal section of the lead screw a bushing is mounted non-rotatably but in an axially sliding fashion, such bushing being able to bear via an annular shoulder against an annular counter shoulder on the hollow shaft or a housing connected with same, with a braking effect and which is acted upon by a compression spring encircling the section, which compression spring bears at one end against the bushing and at the other end against a collar or a nut screwed on the lead screw, and furthermore means is provided for dislodging the bushing from its braking position for holding the bushing in a non-rotatable fashion. This development of the invention renders possible a simple adjustment of the knife carriers because, with the bushing thrust in and held in a non-rotatable manner, the hollow shaft is turned so that via the lead screw nut the slide arrangement is shifted in the hollow shaft and the knife carrier is set in the desired manner.

The means for dislodging and holding the bushing may comprise a piston and cylinder unit operated by fluid under pressure and fixed in relation to the frame, the piston rod thereof bearing a non-rotatable coupling member with claws, which fit into receiving means of the bushing, hold same in a non-rotatable manner and thrust same out of its braking position. In order to increase the braking effect it is convenient to place a brake ring of friction enhancing material between the annular shoulder and the annular counter shoulder.

An other preferred feature of the invention is such that the hollow shaft is driven by a controllable step motor. This step motor may be operated by a computer in such a manner that for setting the knife carrier the hollow shaft is turned into a position, in which the claws of the coupling member are aligned with the receiving means of the bushing. Once the claws are received in the receiving means of the bushing and once the claws have thrust the bushing out from the braking position thereof, it is possible for the hollow shaft to be rotated through a predetermined angle using the computer in order to produce any desired radial setting of the knife bar.

It is naturally possible also to provide a plurality of knife carriers on the knife roll shaft. Preferably two expanding grilles bearing knife carriers are provided with bilateral symmetry about a diametral plane of the knife roll shaft, the inner links of same being mounted on common pivot pins. Offset by 90° in relation to such two knife carriers it is possible for two further knife carriers to be arranged in the same adjustable manner.

It is convenient for the knife carriers to be borne by two expanding grilles respectively arranged in pairs, something enhancing the strength of the knife carriers.

As part of a further development of the invention the knife is secured to a knife bar, which is connected by gripping levers, mounted rotatably in pairs on the knife carrier, disconnectably with the same. This arrangement renders possible a rapid replacement of the knives, when same have become blunt or another type (smooth or perforating) of cut is desired.

It is convenient for the gripping levers to comprise bell cranks pivoted on the knife carriers, of which each one is urged by a compression spring in the opening direction and has an inwardly pointing arm, on which means holding the gripping lever in its locked position acts. This means can comprise a locking rod running in an axially sliding manner in the knife carrier or a slide, which is provided with cams or rotary runners, which for locking of the gripping levers run onto ramp surfaces on the inner arms thereof and for unlocking are able to be thrust away from the same. The slide may be urged in the unlocking direction by a spring and be held in its locking position by a lever able to be swung in its past-dead-center position.

A glue application roll intended for providing a running web with glue areas or, respectively, transversely extending glue patches may be designed in a similar fashion to the knife roll. Accordingly in a further embodiment of the invention there is a provision unit such that the knife carrier is a means bearing a carrier for a glue application bar. One embodiment of the invention will now be described with reference to the drawing in detail.

DESCRIPTION OF THE PREFERRED EMBODIMENTS

Figure 1:
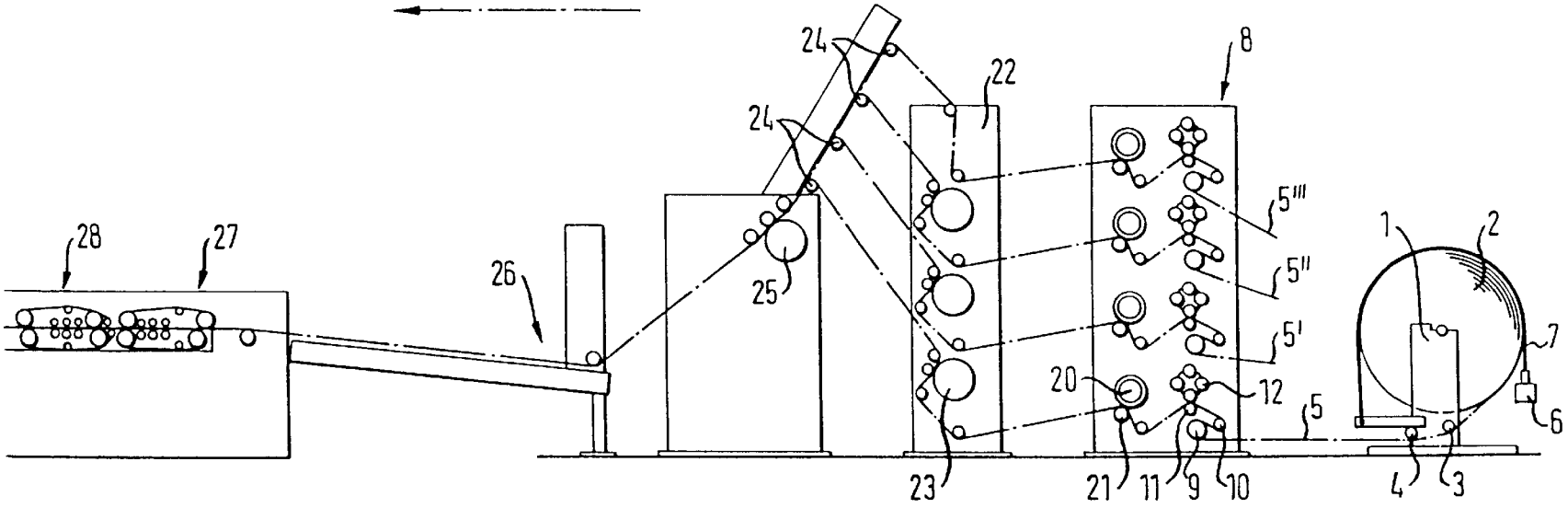
FIG. 1 shows an apparatus for the production of multi-ply tubular members of paper starting with paper webs drawn off supply rolls in a diagrammatic lateral elevation, in which the variable-diameter knife rolls are employed.

The apparatus depicted in FIG. 1 for the production of multi-ply tubular blanks of paper comprises four tandem-arranged frames, in which rolls of paper are supported for rotation and from each of which the paper webs are drawn off, from which the multi-ply tubular blanks are produced.

In FIG. 1 only one frame 1 is to be seen, in which a roll 2 of paper is suspended in a freely rotatable manner so that paper web 5 may be drawn off over bend rollers 3 and 4. Over the paper roll 1 a belt 7 loaded by a weight 6 is laid, which is held in fixed relationship to the frame and serves to brake the paper roll 2. The unwinding device is of known design and is consequently not described here in detail. The paper webs 5', 5" and 5''' are drawn off from paper further rolls (not illustrated), which are mounted in the same fashion in frames serving for unwinding. The paper webs 5 through 5''' are drawn into a frame 8, in which the pin rolls and the knife rolls are rotatably mounted which provide the webs with transverse perforation cuts. Since all paper webs are processed in the same manner, in the following only the rolls processing the web 5 will be described.

The paper web 5 is drawn into the frame 8 using a power driven feed means, which comprises the driven feed roll 9 and the idler roll 10 increasing the angle through which the web is trained about same. Coming from the feed rolls 9 and 10 the paper web runs over a counter thrust roll 11, with which pin rolls 12, rotatably mounted in a rotatable turret frame, are able to be brought into engagement, such pin rolls providing the web either over its full area or in strips with pin perforations serving for venting bags produced from the paper web. Since the pin perforations in the individual paper webs 5 through 5''' are not aligned after collating the webs, labyrinth-like venting passages are created, through which air but not the bagged material may escape.

The rotatable mounting of the pin rolls in the turret serves for rapid exchange or substitution of the pin rolls, when the pins thereof have become blunt or when paper webs are to be perforated in different regions thereof.

Coming from the pin rolls the paper webs run to the knife roll 20, which is engaged with a counter thrust roll 21. The knife rolls 20 and the counter thrust roll 21 will be described in more detail with reference to FIGS. 2 through 6. From the stand 8 the paper webs provided with pin perforations and transverse lines of perforations run to a stand 22, in which the paper webs 5, 5' and 5" are provided with transversely extending glue strips by glue application rolls 23, on each side of the transverse perforation cuts.

The paper webs provided with glue areas are then led together in the manner indicated using bend rolls 24 in such a manner that the individual webs are offset laterally in relation to one another. The lateral regions, which are not overlapped, are then provided by glue application disks 25 with longitudinally extending glue areas or patches. The paper webs are then folded in a tubular blank forming station 26 to give a tubular paper member such that owing to the longitudinal glue areas each of the paper plies is glued to itself to provide such tubular blank or hose and tubular blanks of paper surrounding each other are produced from the paper webs. The thus produced paper tube then runs in a known manner into an advancing unit 27 drawing the paper tube forward and simultaneously holding it at the speed of advance. Following this advancing unit there is a tear off unit 28, rotating at a higher speed, which parts the paper along the lines of perforations and accordingly tears off the individual tubular blanks from the continuous tubular web, such blanks then being processed to produce bags. The advancing unit 27 together with the tear off unit 28 are also of known design so that same do not have to be described here in detail.

The knife roll 20 will now be described in more detail with reference to FIGS. 2 through 6.

The knife roll 20 comprises a hollow shaft 30, which is rotatably mounted using anti-friction bearings in the illustrated manner in the side parts 31 and 32 of the frame 8. The left end of the knife roll shaft 30 is provided with a drive pulley 33, via which the knife roll shaft 30 is driven by a step motor, not illustrated, operated by a computer.

In the bore 34 of the hollow shaft 30 sliding rods 35 and 36 are mounted for longitudinal sliding movement, same bearing a lead screw nut 37 at the right end thereof. A lead screw 38, which will be described in more detail infra with reference to FIG. 3, runs in the lead screw nut 37.

Two links 41, 42, 41' and 42' are pivoted on radial pins 40 and 40' attached to the hollow shaft 30 with a spacing between them. On sliding rods 35, 36, that is to say on transverse members connecting them together, pins 43 and 43' are attached, such pins extending through the wall of the hollow shaft 30 in mutually spaced out slots 44 and 44'. On such pins 43 and 43' the inner ends of links 45, 45' and 46, 46' are pivoted. The links are articulatingly connected together in the manner depicted in the joints 47, 48 and 47', 48' by means of pivot pins (not illustrated), the outer arms of the links 45, 45' and 46, 46' extending past the joints 47, 48 and 47', 48' radially outward. The expanding grilles constituted by the links are arranged with bilateral symmetry about a diametral plane, extending through the pivot pins 40, 43 and 40', 43', of the hollow shaft. The hollow shaft 30 is provided on the opposite side in a corresponding manner with aligned expanding grilles, the respectively outer ends of the longer links of the expanding grilles being connected at the joint points 50, 51 and 50', 51' with the knife carriers 52 and 52'. The knife carriers 52 and 52' serve to hold perforating knives 53 and 53', arranged on a common diametral plane of the hollow shaft 30, which perforating knives produce the perforation cuts in the paper web running between the knife roll 20 and the counter thrust roll 21. The counter thrust roll 21 is mounted adjustably in the frame 8 and is provided with an elastic casing 55, in which the perforating knives are impressible in order to perform the perforating cuts.

Figure 3:
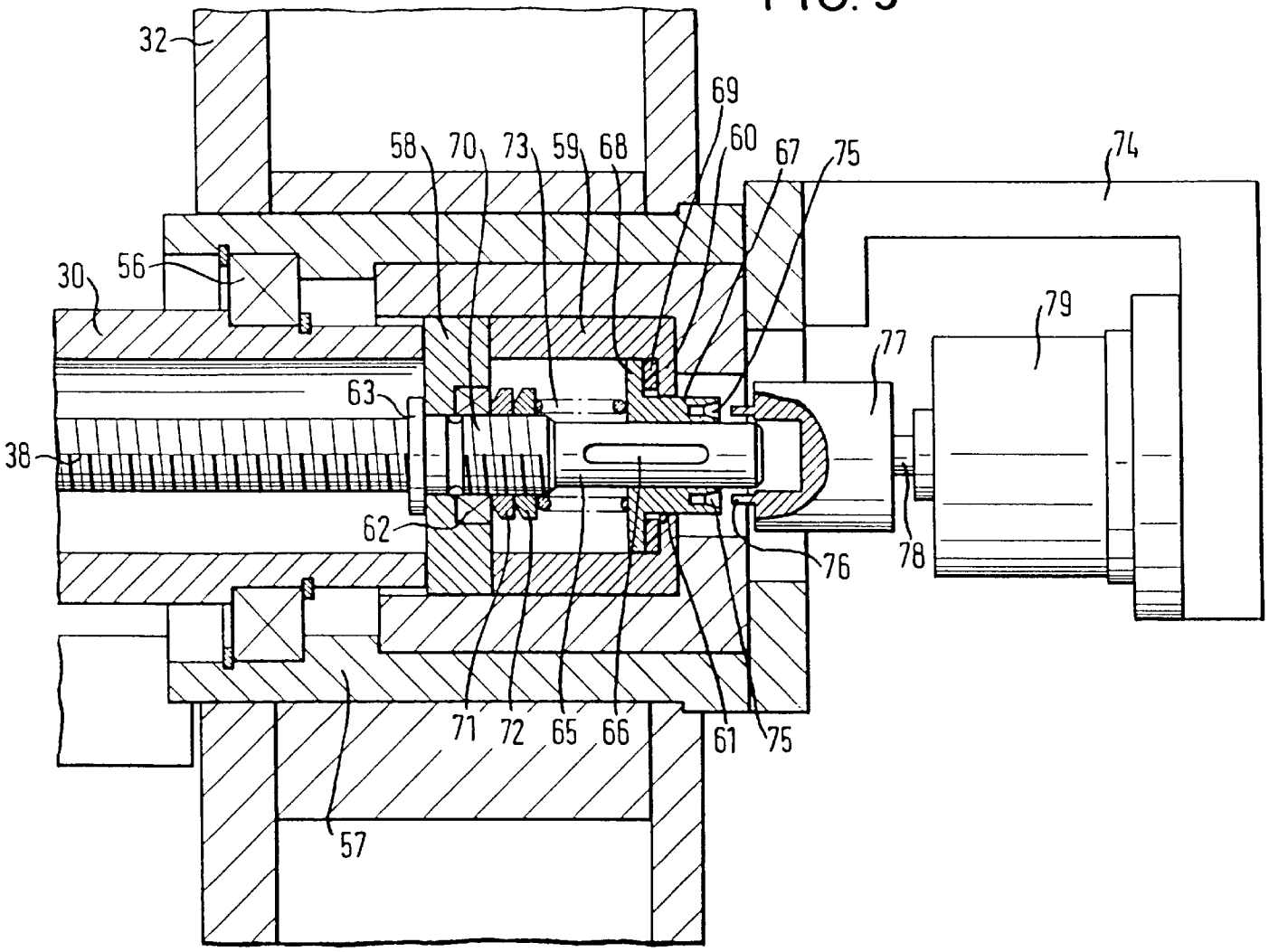
FIG. 3 shows the part denoted by a circle in FIG. 2 on a larger scale.

The adjusting mechanism for the knife roll will be now described in more detail with reference to FIG. 3. The right end of the hollow shaft 30 is rotatably mounted by means of anti-friction bearings 56 in a bearing bushing 57, which is secured in the side wall 32 of the frame 8. The end extending past the bearing 56, of the hollow shaft has a disk 58 fixed to it, which bears a housing part 59 in the form of a cylindrical segment, which on its right end is provided with an inwardly facing annular shoulder 60, whose inner edge delimits a through opening 61. In a middle bearing hole in the disk 58 the lead screw 38 is mounted for free rotation by means of an anti-friction bearing 62. Adjacent to its inner side of the disk 58 the lead screw bears an annular collar 63, by way of which the lead screw 38 may bear in a sliding manner on the disk 58. Instead of this plain bearing means it would be possible to have a thrust bearing consisting of an anti-friction bearing.

At its right end the lead screw 38 has a smooth walled journal 65 or trunnion, which is provided with a longitudinally extending keyway 66. On the shaft section 65 a bushing 67 is able to ride axially while being locked in rotation thereon, such bushing also having a keyway, a key being arranged as a means preventing relative rotation in the aligned keyways. The bushing 67 is provided at its inner with a ring 68 widened out in the form of a flange. Between the annular shoulder 60 of the housing 59 and the widened annular-collar-like part 68 of the bushing 67 a brake ring 69 is placed. Following the pin 65 the lead screw 38 is provided with a screw threaded portion 70, on which two nuts 71 and 72 cooperating with each other as lock nuts are screwed. Between the nuts 71, 72 and the bushing 67 a compression spring 73 is placed on the pin 65, which urges the bushing 67 outward to accordingly perform a braking action on the annular shoulder 60. In order to set the biasing action of the compression spring 73 the two locking nuts 71 and 72 may be adjusted. The bushing 67 extends through the hole 61 and in its annular terminal surface has funnel-shaped, widening receiving holes 75, into which the claws 76 of a coupling member 77 may fit. The coupling member 77 is arranged in such a manner as to prevent relative rotation on the piston rod 78 of a piston and cylinder unit 79 operated by fluid under pressure and which is connected via a cranked support member 74 with the bearing bushing 57. The piston rod 78 runs non-rotatably in the cylinder 79.

For adjustment of the radial clearance between the knife carriers 52 and 52' and the hollow shaft 30 a step motor operated by a computer is turned into a position, in which pins 76 of the coupling member 77 are aligned with the recess 75. Then the piston rod 78 is moved outward axially so that the bushing 67 is coupled with the coupling member 77 in such a manner as to prevent relative rotation and the coupling member 77 shifts the bushing 67 to the left so that the annular collar 68 comes clear of the brake ring 69 and the hollow shaft 30 is freely rotatable in relation to the lead screw 38.

After this the hollow shaft is turned by the computer operated step motor through an angle which corresponds to the desired radial setting of the knife carriers 52 and 52'. Once the desired adjustment has been performed, the coupling member 77 is moved outward so that the brake is activated and by means of it the lead screw is again coupled with the hollow shaft in such a manner as to prevent relative rotation.

Figure 2:
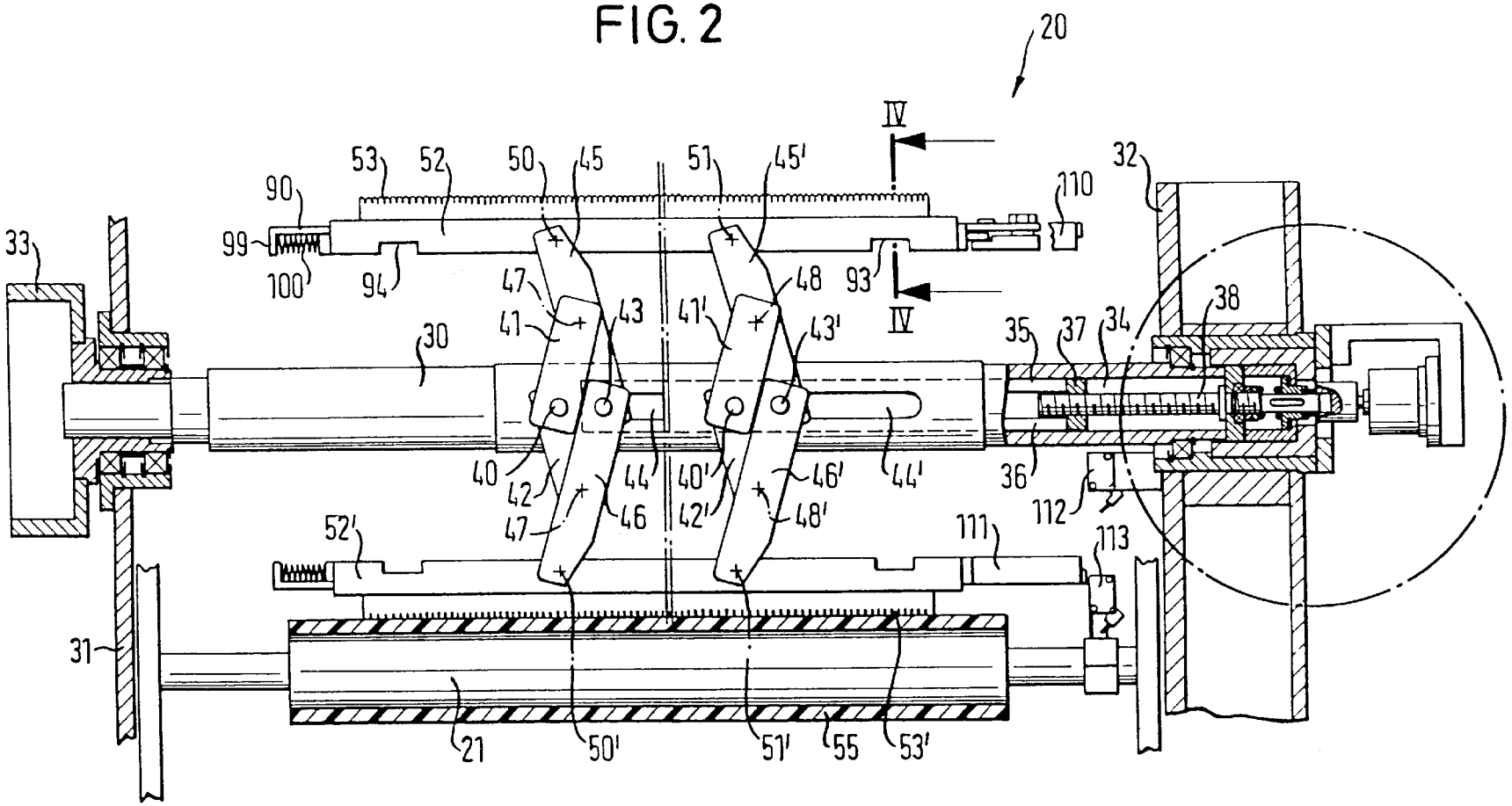
FIG. 2 is a lateral elevation of a knife roll, partly in section.

The knife carriers 52 and 52' are provided in the manner indicated in FIG. 2 with switching lugs 110 and 111, which cooperate with initiators 112 and 113 fixed in relation to the frame and constitute limit switches. The inner initiator 86 limits the withdrawn setting of the knife bars and the initiator 87 delimits the maximum extension setting.

Figure 4:
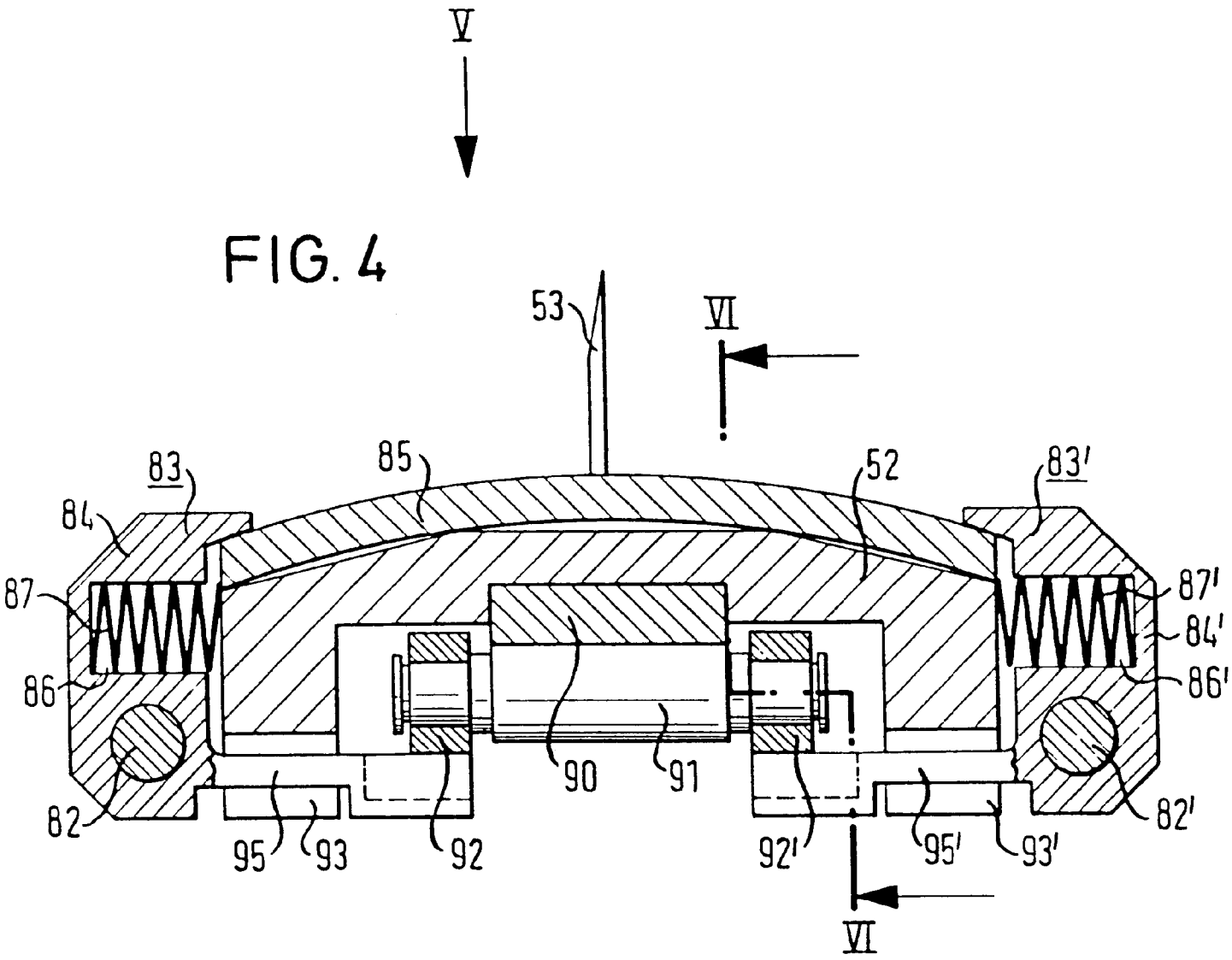
FIG. 4 is a cross section taken through a knife carrier with a knife bearing bar held grippingly on the carrier.

In FIG. 4 the reader will see a section taken through the knife carrier 52 along the line IV—IV of FIG. 2. The knife carrier is, in the manner indicated in FIG. 5, at least provided on opposite sides with bearing members 80, 81 and 80', 81' forming two bearing forks, shafts 82 and 82' being mounted and held in holes in the bearing members and cranked gripping levers 83 and 83' being pivotally mounted on the shafts 82 and 82'. The pivoting levers have arms 84 and 84' thereof overlapping the knife carrier 52 and hold a bar 85 in the form of a cylindrical shell grippingly on the knife carrier 52, such bar 85 having the perforating knife 53 mounted centrally thereon. In order to ensure proper engagement of the bar 85 on the knife carrier, the latter possesses a generally trapezoidal upper shape. The arms 84 and 84' of the gripping levers are provided with holes 86 and 86', in which compression springs 87 and 87' are held, of which one end bears against the floors of the holes and the other end bears against the sides of the knife carrier.

On its lower side the knife carrier 52 is provided with a groove-like recess, in which a slide 90 runs. This slide bears spaced out pins 91 on its lower side and on the terminal journals of such pins there are rotary runners 92 and 92' able to turn freely. In the vicinity of the runners 92 and 92' or casters, the knife carrier 52 is provided with transversely extending grooves 93 and 94, through which the inwardly cranked arms 95 and 95' of the gripping levers extend. The cranked arms are provided terminally with wedge-like ramp surfaces 96 which are adjacent to the rotary runners 92 and 92' so that by thrusting such runners onto these ramp surfaces by suitable shifting of the slides 90 the gripping levers are arrested in their position illustrated in FIG. 4. By sliding the slide 90 in the opposite direction the inwardly cranked arms 95 and 95' come clear of the rotary runners so that the compression spring 87 and 87' pivot the gripping levers outward and accordingly release the bar bearing the knife 53 and same may be replaced when necessary simply and rapidly.

Figure 5:
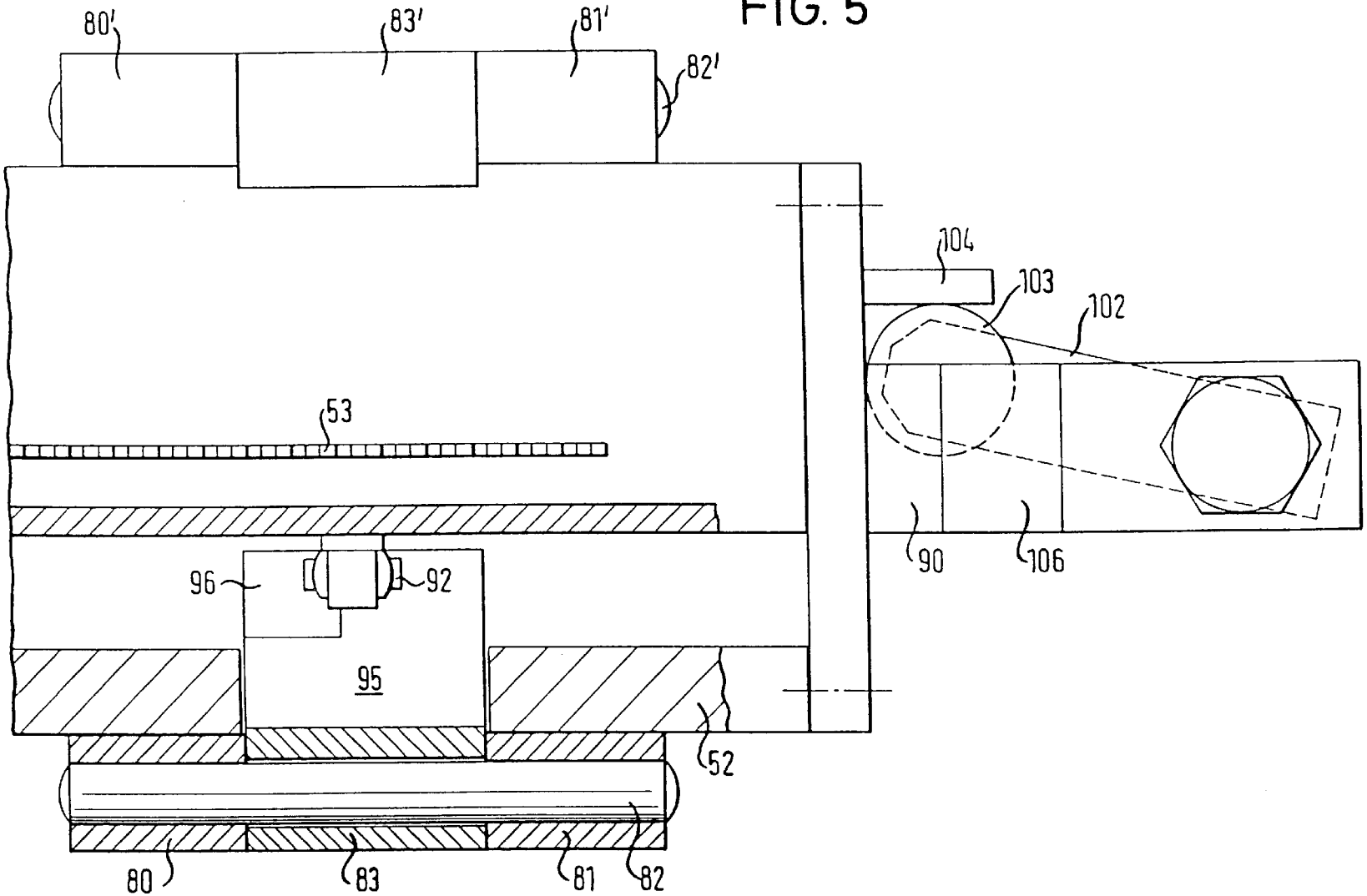
FIG. 5 is a plan view looking in the direction of the arrow V of FIG. 4 of the knife carrier, partially in section.
Figure 6:
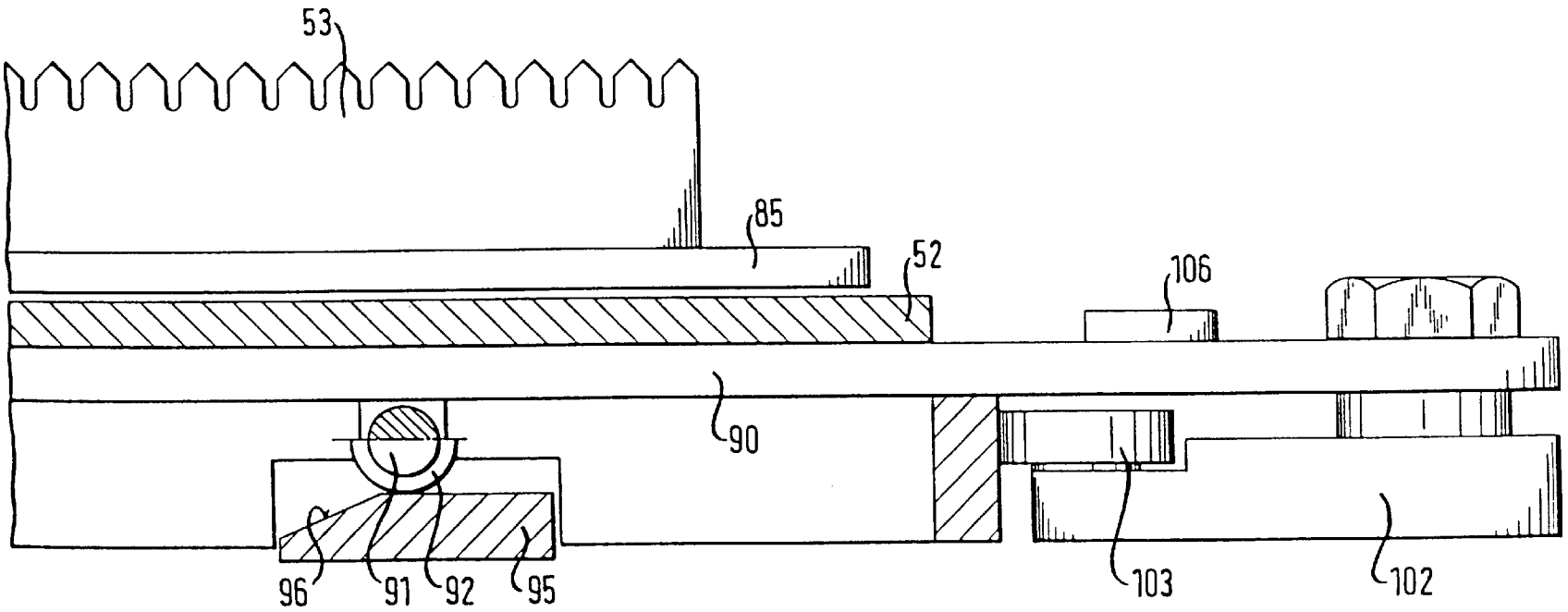
FIG. 6 is a section taken along the line VI—VI of FIG. 4.

The slide 90 extends past the knife carriers 52 and 52' as shown in FIG. 2 and at its end it is provided with a cranked part 99, a compression spring 100 being held clamped between the cranked part and the end surface of the knife carrier 52, such compression spring urging the slide 90 into a position releasing the gripping levers. The slide 90 extends past the knife carrier 52 also on its opposite side. On same side a lever 102 is pivotally mounted, which at its free end extending upward bears a rotary runner 103. To the side adjacent to slide 90 the right terminal surface of the knife carrier 52 is provided with an abutment 104, on which the slide, urged by the compression spring 100, is held in its past-dead-center-position as shown in FIG. 5 locking the gripping levers 83 and 83'. For releasing the gripping lever the locking lever 102 is moved out of its position as shown in FIG. 5 anti-clockwise until it releases the slide 90. An abutment 106 is provided on the slide 90, which limits movement of the slide into the knife carrier. The size of this inward movement is generally equal to the length of the ramp surface 96 so that the slide released by the arresting lever 102 is shifted to the left by the compression spring 100 in a position in which the gripping levers 83 and 83' release the knife bar 85.

We claim:

1. A variable-diameter knife roll comprising a knife extending parallel to an axis of the roll placed generally radially on a diametral plane, such knife being mounted on a knife carrier able to be adjusted radially outwardly and inwardly, wherein the knife carrier is articulatingly connected with two expanding grilles, with one inner joint of a link of one of the two expanding grilles being arranged fixedly on a knife roll shaft and another innerjoint of another link being arranged for adjustment in the axial direction on or in the knife roll shaft.

2. The knife roll as claimed in claim 1, wherein said two expanding grilles bearing a plurality of the knife carriers, are provided with bilateral symmetry about a diametral plane of the knife roll shaft, and comprise common pivot pins about which the inner links of the grilles are mounted.

3. The knife roll as claimed in claim 2, wherein the knife carriers (52, 52') are borne by two expanding grilles respectively arranged in pairs.

4. The knife roll as claimed in claim 1, wherein the knife (53, 53') is secured to a knife bar (85) releasably which is connected by gripping levers (83, 83'), mounted rotatably in pairs on the knife carrier.

5. The knife roll as claimed in claim 4, wherein the gripping levers comprise bell cranks (83, 83') pivoted on the knife carrier, of which each bell crank is urged by a compression spring (87, 87') in the opening direction and has an inwardly pointing arm (95, 95'), on which means for holding the gripping lever in its locked position acts.

6. The knife roll as claimed in claim 5, wherein said holding means comprises a slide which is provided with cams or rotary runners, which for locking of the gripping levers run onto ramp surfaces on the inwardly pointing arms of the bell cranks and for unlocking, said cams or rotary runners are able to be thrust away from the ramp surfaces.

7. The knife roll as claimed in claim 6, wherein the slide is urged in an unlocking direction by a second spring and is, in a locking position releasably held by a lever arranged to be pivotably moved in a past-dead-center position.

8. The knife roll as claimed in claim 1, characterized in that the knife carrier (52, 52') is arranged as a a carrier for a glue applying bar.

9. The knife roll as claimed in claim 1, wherein the knife carrier is articulatingly connected with joints connecting two of the links of the two expanding grilles.

10. The knife roll carrier as claimed in claim 1, wherein the knife carrier is articulatingly connected with a respective one of arms extending past joints of one of the links of the two expanding grilles.

11. The knife roll as claimed in claim 6, wherein said holding means comprises a locking rod running in an axially sliding manner in the knife carrier.

* * * * *